US005839403A

United States Patent [19]

Grant et al.

[11] Patent Number: 5,839,403

[45] Date of Patent: Nov. 24, 1998

[54] QUICK CHANGE PLUG

[76] Inventors: Larry D. Grant, 923 Woodlawn Dr., Colombiaville, Mich. 48421; Jeffrey M. Aird, 2390 Maybury, New Bloomfield, Mich. 48324

[21] Appl. No.: 897,894

[22] Filed: Jul. 21, 1997

[51] Int. Cl.[6] ..... H01T 13/08

[52] U.S. Cl. ..... 123/169 R; 313/135

[58] Field of Search ..... 123/169 PA, 169 PH, 123/169 R, 169 CB; 313/135, 148

[56] References Cited

U.S. PATENT DOCUMENTS

| | | | |
|---|---|---|---|
| 3,747,583 | 7/1973 | Spengler et al. | 123/169 R |
| 5,186,132 | 2/1993 | Runge | 123/169 R |
| 5,283,499 | 2/1994 | Adam et al. | 123/169 R |
| 5,706,847 | 1/1998 | Strait et al. | 123/169 PA |

*Primary Examiner*—Erick R. Solis

[57] ABSTRACT

A spark plug quick release system is provided including a spark plug with an annular detent formed therein. An adapter is provided with a hollow cylindrical configuration having a lower end with a plurality of threaded grooves formed in an outer surface thereof for screwably coupling with a spark plug threaded mount. Next provided is a quick release assembly including a sliding tube slidably situated about an outer surface of the adapter. By this structure, the sliding tube has a lowered orientation and a raised orientation wherein ball bearings protrude from the corresponding circular aperture of the adapter. As such, upon the lowering of the quick release assembly and the insertion of the spark plug within the adapter, the quick release assembly may be released such that the ball bearings engage the annular detent of the spark plug.

5 Claims, 2 Drawing Sheets

QUICK CHANGE PLUG

BACKGROUND OF THE INVENTION

1. Field of the Invention

The present invention relates to spark plug mounting assemblies and more particularly pertains to a new QUICK CHANGE PLUG for conveniently installing and removing a spark plug.

2. Description of the Prior Art

The use of spark plug mounting assemblies is known in the prior art. More specifically, spark plug mounting assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art spark plug mounting assemblies include U.S. Pat. No. 5,186,132; U.S. Pat. No. 5,241,930; U.S. Pat. No. Des. 284,001; U.S. Pat. No. 3,940,649; U.S. Pat. No. 5,171,028; and U.S. Pat. No. 4,373,478.

In these respects, the QUICK CHANGE PLUG according to the present invention substantially departs from the conventional concepts and designs of the prior art, and in so doing provides an apparatus primarily developed for the purpose of conveniently installing and removing a spark plug.

SUMMARY OF THE INVENTION

In view of the foregoing disadvantages inherent in the known types of spark plug mounting assemblies now present in the prior art, the present invention provides a new QUICK CHANGE PLUG construction wherein the same can be utilized for conveniently installing and removing a spark plug.

The general purpose of the present invention, which will be described subsequently in greater detail, is to provide a new QUICK CHANGE PLUG apparatus and method which has many of the advantages of the spark plug mounting assemblies mentioned heretofore and many novel features that result in a new QUICK CHANGE PLUG which is not anticipated, rendered obvious, suggested, or even implied by any of the prior art spark plug mounting assemblies, either alone or in any combination thereof.

To attain this, the present invention generally comprises spark plug having a cylindrical configuration. Such spark plug is constructed from a material from the group of materials including ceramic. A rod-like first conductor is situated between a top end and a bottom end of the spark plug and is extended therefrom. Associated therewith is a second sleeve conductor formed on an outer surface of the spark plug about a lower surface of the spark plug. Such second sleeve conductor terminates short of the bottom end of the spark plug to define a ledge. The second conductor further includes an L-shaped arm extending from a lower surface of the sleeve with a lower horizontal portion slightly spaced from the first conductor. A vertical portion resides flush with an outer surface of the ceramic spark plug. For reasons that with become apparent hereinafter, the second sleeve conductor further has an annular detent formed therein in concentric relationship therewith above the ledge defined by the second sleeve conductor. Next provided is an adapter with a hollow cylindrical configuration. As shown in FIG. 3, the adapter has a lower end with a plurality of threaded grooves formed in an outer surface thereof for screwably coupling with a spark plug threaded mount. An upper end of the adapter is equipped with an annular outwardly extending lip integrally coupled thereto and extended radially outwardly therefrom. An annular inwardly extending lip is integrally coupled to an inner surface of the adapter above the threaded grooves and extended radially inwardly therefrom. The adapter further has an annular flange integrally coupled to the outer surface of the lower end and extended radially outwardly therefrom. A plurality of circular apertures are formed in the adapter and situated between the outwardly extending annular lip and annular flange. For allowing the screwable engagement of the adapter in the aforementioned threaded mount by way of a wrench, the adapter has a square cross-section between the annular lip and circular apertures. In use, the spark plug may be situated within the adapter such that the ledge thereof engages the annular inwardly extending lip of the adapter. When the spark plug is inserted, it is imperative that there be a slight space between the inner surface of the adapter and the outer surface of the spark plug. Also included is a quick release assembly including a sliding tube. Such sliding tube is equipped with an annular tab integrally coupled to an outer surface thereof adjacent a top end thereof. The annular tab extends radially outwardly from the sliding tube. A plurality of cylindrical inset portions are formed in an inner surface of the sliding tube with the cylindrical inset portions having an upper wall and a lower tapered wall. A downwardly extending sleeve is integrally coupled to a lower end of the sliding tube and defines a continuation of the outer surface thereof. The sliding tube of the quick release assembly is slidably situated about the outer surface of the spark plug with at least a pair of heat resistant springs situated between the lower end of the sliding tube and a top end of the annular flange of the adapter. As shown in FIG. 3, the downwardly extending sleeve of the sliding tube is in slidable communication with an outer surface of the annular flange of the adapter. A ball bearing is situated within each cylindrical inset portion of the sliding tube and circular aperture of the adapter. By this structure, the sliding tube has a lowered biased orientation with the ball bearings situated within the associated one of the cylindrical inset portions above the tapered end thereof and a raised unbiased orientation wherein the ball bearings abut the tapered ends of the associated one of the cylindrical inset portions and protrude from the corresponding circular aperture of the adapter. In use, upon the lowering of the quick release assembly and the insertion of the spark plug within the adapter, the quick release assembly may be released such that the ball bearings engage the annular detent of the spark plug.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new QUICK CHANGE PLUG apparatus and method which has many of the advantages of the spark plug mounting assemblies mentioned heretofore and many novel features that result in a new QUICK CHANGE PLUG which is not anticipated, rendered obvious, suggested, or even implied by any of the prior art spark plug mounting assemblies, either alone or in any combination thereof.

It is another object of the present invention to provide a new QUICK CHANGE PLUG which may be easily and efficiently manufactured and marketed.

It is a further object of the present invention to provide a new QUICK CHANGE PLUG which is of a durable and reliable construction.

An even further object of the present invention is to provide a new QUICK CHANGE PLUG which is susceptible of a low cost of manufacture with regard to both materials and labor, and which accordingly is then susceptible of low prices of sale to the consuming public, thereby making such QUICK CHANGE PLUG economically available to the buying public.

Still yet another object of the present invention is to provide a new QUICK CHANGE PLUG which provides in the apparatuses and methods of the prior art some of the advantages thereof, while simultaneously overcoming some of the disadvantages normally associated therewith.

Still another object of the present invention is to provide a new QUICK CHANGE PLUG for conveniently installing and removing a spark plug.

Even still another object of the present invention is to provide a new QUICK CHANGE PLUG that includes a spark plug with an annular detent formed therein. An adapter is provided with a hollow cylindrical configuration having a lower end with a plurality of threaded grooves formed in an outer surface thereof for screwably coupling with a spark plug threaded mount. Next provided is a quick release assembly including a sliding tube slidably situated about an outer surface of the adapter. By this structure, the sliding tube has a lowered orientation and a raised orientation wherein ball bearings protrude from the corresponding circular aperture of the adapter. As such, upon the lowering of the quick release assembly and the insertion of the spark plug within the adapter, the quick release assembly may be released such that the ball bearings engage the annular detent of the spark plug.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
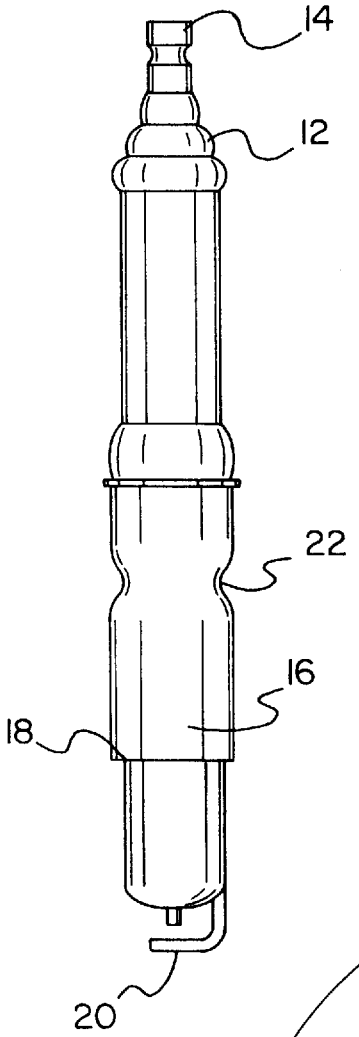
FIG. 1 is a side view of a new QUICK CHANGE PLUG according to the present invention.
Figure 2:
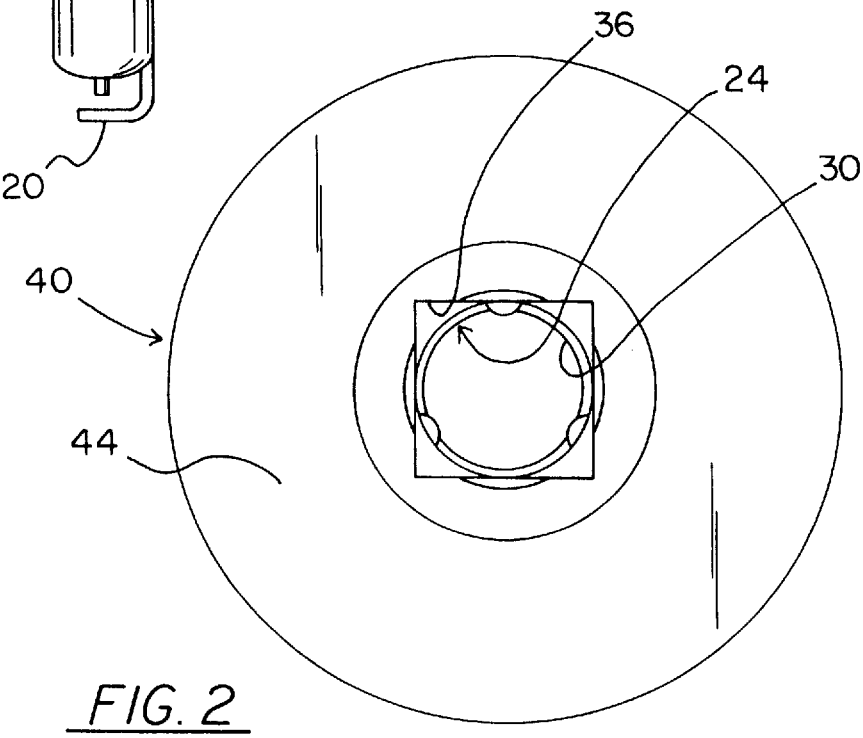
FIG. 2 is a top view of the adapter and quick release assembly of the present invention.
Figure 3:
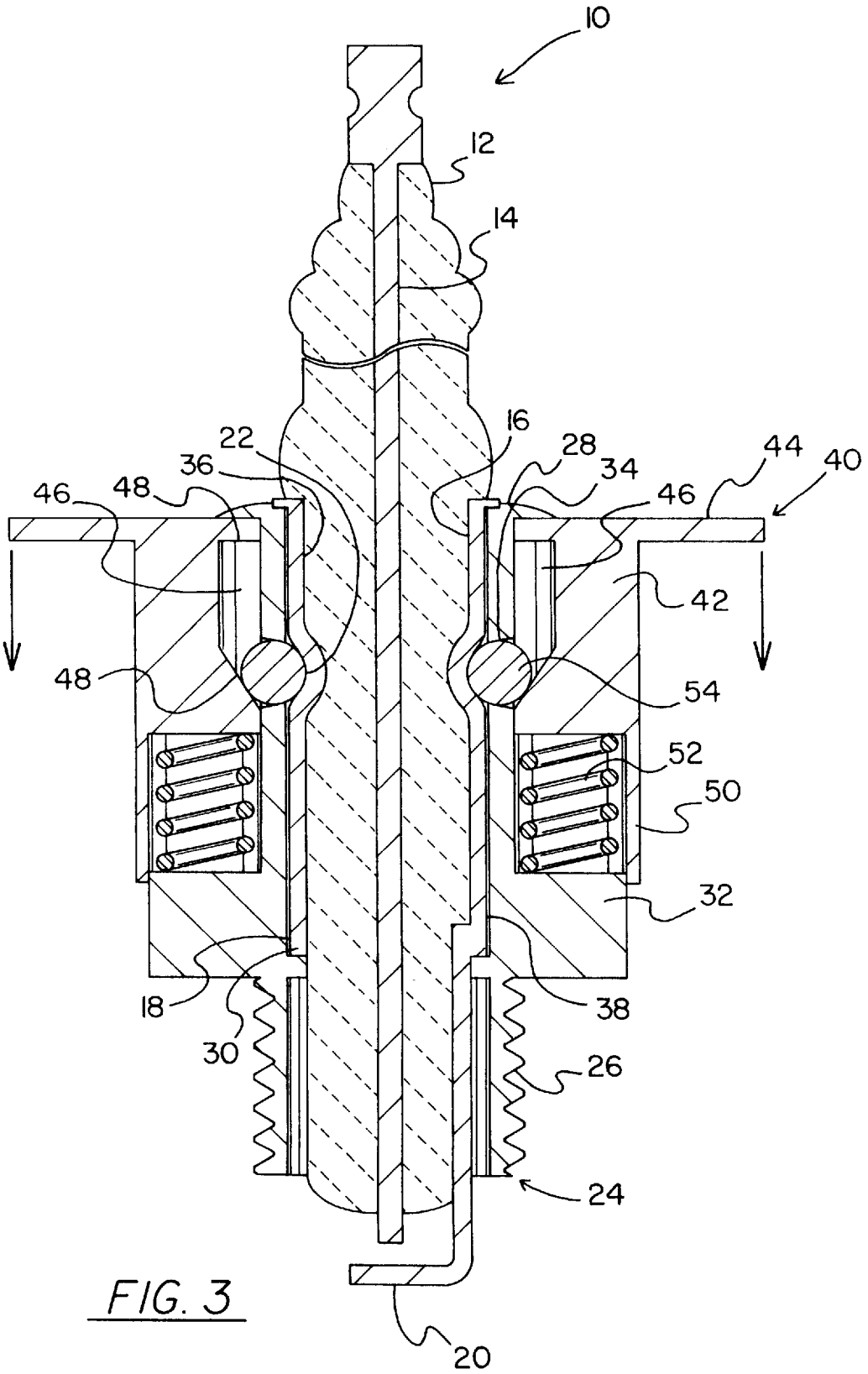
FIG. 3 is a cross-sectional view of the present invention.

With reference now to the drawings, and in particular to FIGS. 1 through 3 thereof, a new QUICK CHANGE PLUG embodying the principles and concepts of the present invention and generally designated by the reference numeral 10 will be described.

As shown in FIGS. 1 & 3, a spark plug 12 is included having a cylindrical configuration. Such spark plug is constructed from a material from the group of materials including ceramic. A rod-like first conductor 14 is situated between a top end and a bottom end of the spark plug and is extended therefrom. The top end of the first conductor is adapted to releasably receive a conventional spark plug cap.

Associated therewith is a second sleeve conductor 16 formed on an outer surface of the spark plug about a lower surface of the spark plug. Such second sleeve conductor terminates short of the bottom end of the spark plug to define a ledge 18. The second conductor further includes an L-shaped arm 20 extending from a lower surface of the sleeve with a lower horizontal portion slightly spaced from the first conductor. A vertical portion of the arm resides flush with an outer surface of the ceramic spark plug. For reasons that with become apparent hereinafter, the second sleeve conductor further has an annular detent 22 formed therein in concentric relationship therewith above the ledge.

Next provided is an adapter 24 with a hollow cylindrical configuration. As shown in FIG. 3, the adapter has a lower end with a plurality of threaded grooves 26 formed in an outer surface thereof for screwably coupling with a conventional unillustrated spark plug threaded mount. An upper end of the adapter is equipped with an annular outwardly extending lip 28 integrally coupled thereto and extended radially outwardly therefrom. An annular inwardly extending lip 30 is integrally coupled to an inner surface of the adapter above the threaded grooves and extended radially inwardly therefrom. The adapter further has an annular flange 32 integrally coupled to the outer surface of the lower end and extended radially outwardly therefrom. A plurality of circular apertures 34 are formed in the adapter and situated between the outwardly extending annular lip and annular flange.

For allowing the screwable engagement of the adapter in the aforementioned threaded mount by way of a socket wrench, a hollow interior of the adapter has an square cross-section 36 between the annular lip and circular apertures. In use, the spark plug may be situated within the adapter such that the ledge thereof engages the annular inwardly extending lip of the adapter. Such engagement is imperative so that no compression is lost during use. While not shown, a washer is preferably positioned between the inwardly extending lip and the ledge. A radial thickness of the washer is slightly greater than that of the ledge. When the spark plug is inserted, it is imperative that there be a slight space 38 between the inner surface of the adapter and the outer surface of the spark plug. This allows for heat expansion in order for the spark plug to be removed when either hot or cold.

Also included is a quick release assembly 40 including a sliding tube 42. Such sliding tube is equipped with an annular tab 44 integrally coupled to an outer surface of the sliding tube adjacent a top end thereof. Such annular tab has a radial length of about 0.250 inches. The annular tab extends radially outwardly from the sliding tube. A plurality of cylindrical inset portions 46 are formed in an inner surface of the sliding tube with the cylindrical inset portions having an upper wall 48 and a lower tapered wall 48. A downwardly extending sleeve 50 is integrally coupled to a lower end of the sliding tube and defines a continuation of the outer surface thereof.

The sliding tube of the quick release assembly is slidably situated about the outer surface of the spark plug with at least a pair of heat resistant springs 52 situated between the lower end of the sliding tube and a top end of the annular flange of the adapter. As shown in FIG. 3, the downwardly extending sleeve of the sliding tube is in slidable communication with an outer surface of the annular flange of the adapter. A ball bearing 54 is situated within each cylindrical inset portion of the sliding tube and circular aperture of the adapter.

By this structure, the sliding tube has a lowered biased orientation with the ball bearings situated within the associated one of the cylindrical inset portions above the tapered end thereof and a raised unbiased orientation wherein the ball bearings abut the tapered ends of the associated one of the cylindrical inset portions and protrude from the corresponding circular aperture of the adapter. In use, upon the lowering of the quick release assembly and the insertion of the spark plug within the adapter, the quick release assembly may be released such that the ball bearings engage the annular detent of the spark plug thereby precluding the removal thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A spark plug quick release system comprising, in combination:

a spark plug having a cylindrical configuration and constructed from a material from the group of materials including ceramic and having a rod like first conductor extending between and from a top end and a bottom end of the spark plug, the spark plug further having a second sleeve conductor formed on an outer surface of the spark plug about a lower surface of the spark plug and terminating short of the bottom end thereof to define a ledge, the second conductor further having an L-shaped arm extending from a lower surface of the sleeve with a lower horizontal portion slightly spaced from the first conductor, the second sleeve conductor further having an annular detent formed therein in concentric relationship therewith above the ledge defined by the second sleeve conductor;

an adapter with a hollow cylindrical configuration having a lower end with a plurality of threaded grooves formed in an outer surface thereof for screwably coupling with a spark plug threaded mount and an upper end with an annular outwardly extending lip integrally coupled thereto and extending radially outwardly therefrom and an annular inwardly extending lip integrally coupled to an inner surface of the adapter above the threaded grooves and extending radially inwardly therefrom, the adapter further having an annular flange integrally coupled to the outer surface of the lower end and extending radially outwardly therefrom and a plurality of circular apertures formed therein and situated between the outwardly extending annular lip and annular flange, the adapter having a square cross-section between the annular lip and circular apertures, whereby the spark plug may be situated within the adapter such that the ledge thereof engages the annular inwardly extending lip of the adapter and such that there is a slight space between the inner surface of the adapter and the outer surface of the spark plug; and a quick release assembly including a sliding tube with an annular tab integrally coupled to an outer surface thereof adjacent a top end thereof and extending radially outwardly therefrom, a plurality of cylindrical inset portions formed in an inner surface of the sliding tube with the cylindrical inset portions having an upper wall and a lower tapered wall, a downwardly extending sleeve integrally coupled to a lower end of the sliding tube and defining a continuation of the outer surface thereof, whereby the sliding tube of the quick release assembly is slidably situated about the outer surface of the spark plug with at least a pair of heat resistant springs situated between the lower end of the sliding tube and a top end of the annular flange of the adapter, wherein the downwardly extending sleeve of the sliding tube is in slidable communication with an outer surface of the annular flange of the adapter and a ball bearing is situated within each cylindrical inset portion of the sliding tube and circular aperture of the adapter, whereby the sliding tube has a lowered biased orientation with the ball bearings situated within the associated one of the cylindrical inset portions above the tapered end thereof and a raised unbiased orientation wherein the ball bearings abut the tapered ends of the associated one of the cylindrical inset portions and protrude from the corresponding circular aperture of the adapter;

whereby upon the lowering of the quick release assembly and the insertion of the spark plug within the adapter, the quick release assembly may be released such that the ball bearings engage the annular detent of the spark plug.

2. A spark plug quick release system comprising:

a spark plug having a cylindrical configuration and having a rod like first conductor extending between and from a top end and a bottom end of the spark plug, the spark plug further having a second sleeve conductor formed on an outer surface of the spark plug about a lower surface thereof, the second conductor further having an arm extending from a lower surface of the sleeve with a lower portion slightly spaced from the first conductor, the second sleeve conductor further having an annular detent formed therein in concentric relationship therewith above a ledge defined by the second sleeve conductor;

an adapter with a hollow cylindrical configuration having a lower end with a plurality of threaded grooves formed in an outer surface thereof for screwably coupling with a spark plug threaded mount and an upper end; and a quick release assembly including a sliding tube slidably situated about an outer surface of the adapter, whereby the sliding tube has a lowered orientation and a raised orientation wherein ball bearings protrude from circular apertures of the adapter;

whereby upon the lowering of the quick release assembly and the insertion of the spark plug within the adapter, the quick release assembly may be released such that the ball bearings engage the annular detent of the spark plugs;

wherein the adapter has a portion with a square cross-section.

3. A spark plug quick release system as set forth in claim 2 wherein the second sleeve conductor of the spark plug terminates short of the bottom end thereof to define a ledge, wherein the ledge is adapted to engage an annular inwardly extending lip integrally coupled to an inner surface of the adapter above the threaded grooves upon the insertion of the spark plug within the adapter.

4. A spark plug quick release system as set forth in claim 2 wherein springs are included such that the quick release assembly is biased in the lowered orientation and unbiased in the upper orientation.

5. A spark plug quick release system as set forth in claim 2 wherein when the spark plug is situated within the adapter, there is a slight space between an inner surface of the adapter and the outer surface of the spark plug.

* * * * *